United States Patent [19]

Pearo

[11] 4,285,518

[45] Aug. 25, 1981

[54] BASKETBALL GOAL

[76] Inventor: John M. Pearo, 3211 Castleleigh Rd., Beltsville, Md. 20705

[21] Appl. No.: 112,093

[22] Filed: Jan. 14, 1980

[51] Int. Cl.[3] ..... A63B 63/08

[52] U.S. Cl. ..... 273/1.5 R

[58] Field of Search ..... 273/1.5 R, 1.5 A; 248/214

[56] References Cited

U.S. PATENT DOCUMENTS

| | | | |
|---|---|---|---|
| 1,474,323 | 11/1923 | Geibel | 248/214 |
| 3,462,143 | 8/1969 | Bidelman et al. | 273/1.5 R |

OTHER PUBLICATIONS

Porter Basketball Equipment Catalog, p. 5, 2-1961.

*Primary Examiner*—Paul E. Shapiro

[57] ABSTRACT

A basketball goal consisting of a tempered plate glass backboard, a steel hoop assembly and a steel mounting bracket, designed so that the hoop does not come in direct contact with the backboard but passes through an opening in the backboard and is fastened to a mounting bracket behind the backboard opening. The mounting bracket is anchored to the backboard frame.

1 Claim, 8 Drawing Figures

BASKETBALL GOAL

BACKGROUND OF INVENTION

It has long been a problem in professional and college basketball of the glass backboards cracking or shattering upon excessive force applied when a basketball is slam-dunked through the basketball hoop. This problem arises from the fact that the hoop is mounted directly to the brittle glass backboard by mounting bolts. When force is applied to the hoop the hoop wants to pull away from the backboard but the mounting bolts which anchor the hoop directly to the backboard will not allow this to happen. However, when excessive force is applied to the hoop the hoop will pull on the mounting bolts with such a force that the mounting bolts will break away the glass and the hoop will pull free from the backboard. In the presented invention the hoop is not mounted to the backboard but passes through an opening in the backboard and is mounted to a steel bracket behind the backboard and this steel bracket is anchored to the bottom member of the steel frame. With the presented invention it would be impossible to crack the glass backboard with any force applied to the hoop, since the hoop is not directly mounted to the backboard. Any force applied to the hoop of the presented invention is passed from the hoop to the mounting bracket and from the mounting bracket the force is absorbed into the steel frame around the perimeter of the backboard.

SUMMARY OF INVENTION

It is therefore the objective of the presented invention to provide an improved basketball goal that will not break, crack or shatter upon any force applied to the hoop by employing a steel hoop assembly which is not mounted directly to the backboard, but that passes through an opening in the backboard and is fastened to a mounting bracket located behind the backboard and the mounting bracket is fastened or permanently bound to the backboards steel frame.

BRIEF DESCRIPTION OF THE DRAWINGS

Other objects and advantages of the present invention will be apparent from the following detailed description of a preferred embodiment thereof and from the attached drawings of which.

DESCRIPTION OF PREFERRED EMBODIMENT

Figure 1:
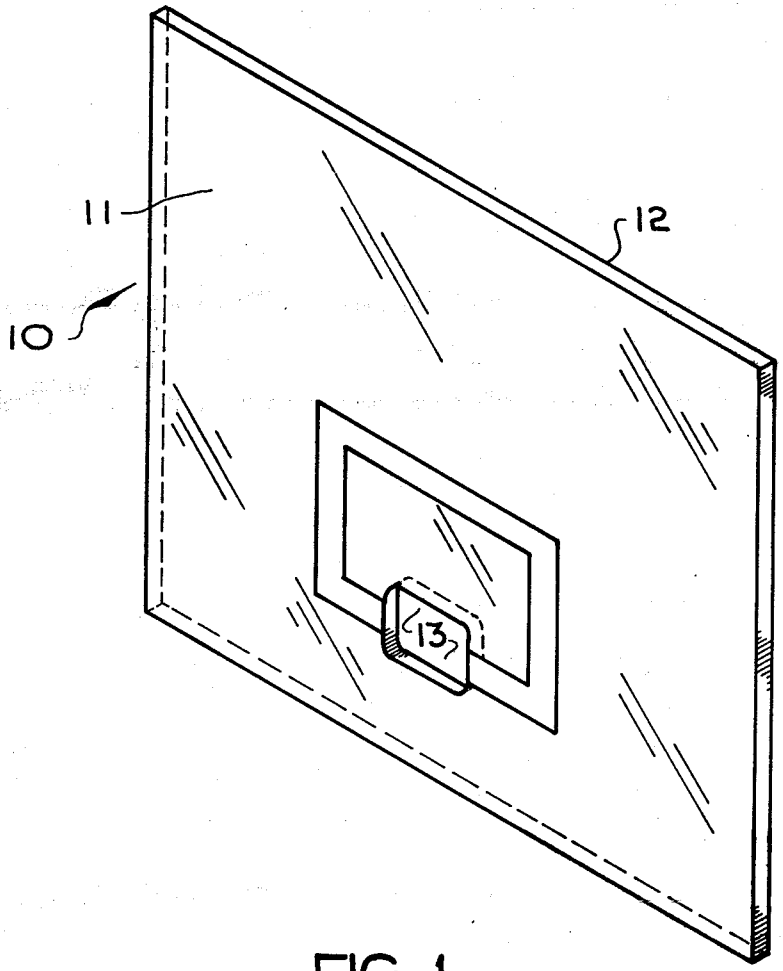
FIG. 1 is a perspective view of a rectangular backboard embodying the present invention.
Figure 5:
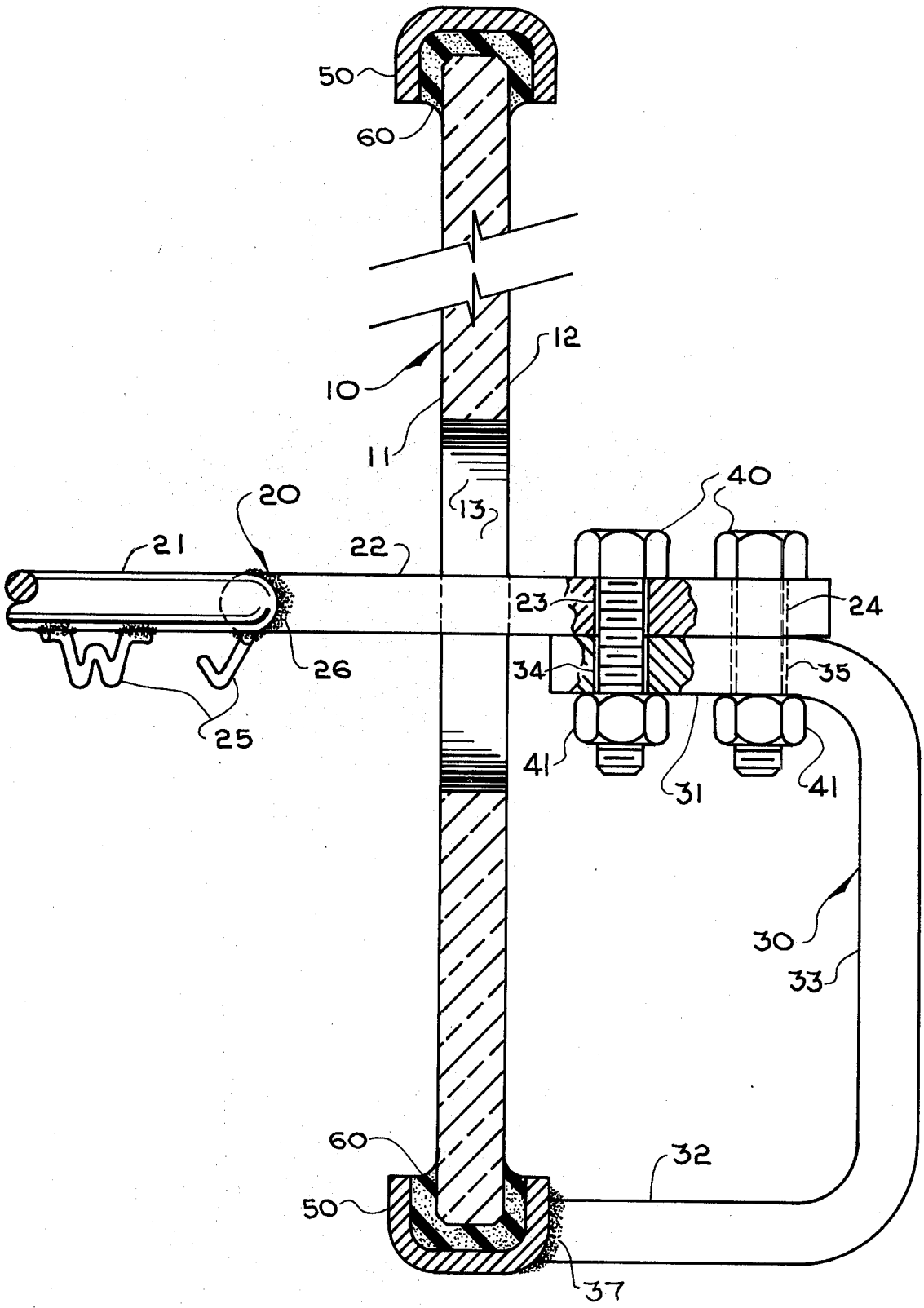
FIG. 5 is a section view of the present invention taken along line 5—5 of FIG. 4.
Figure 6:
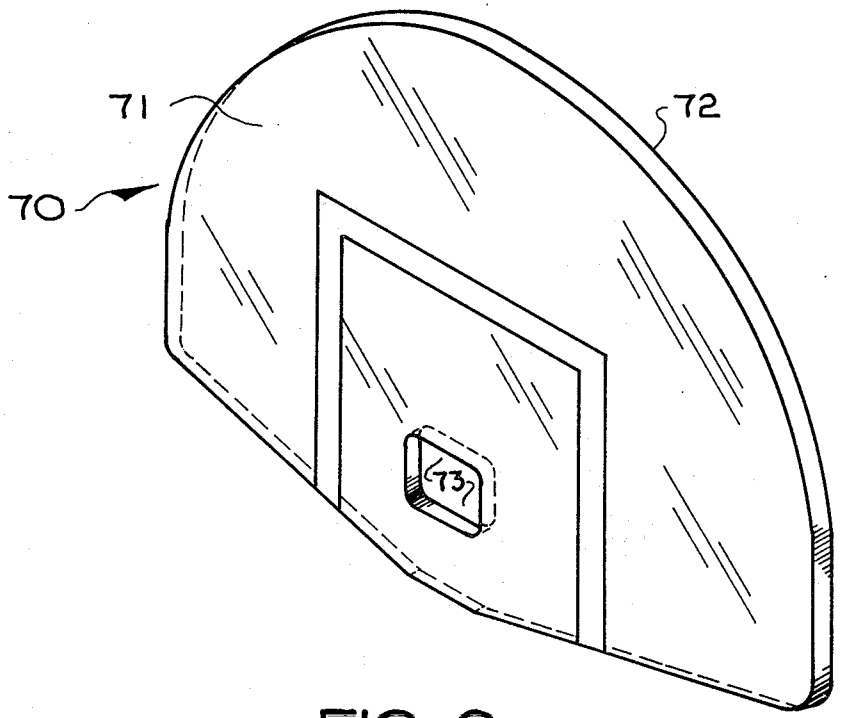
FIG. 6 is a perspective view of a fan type backboard embodying the present invention.
Figure 7:
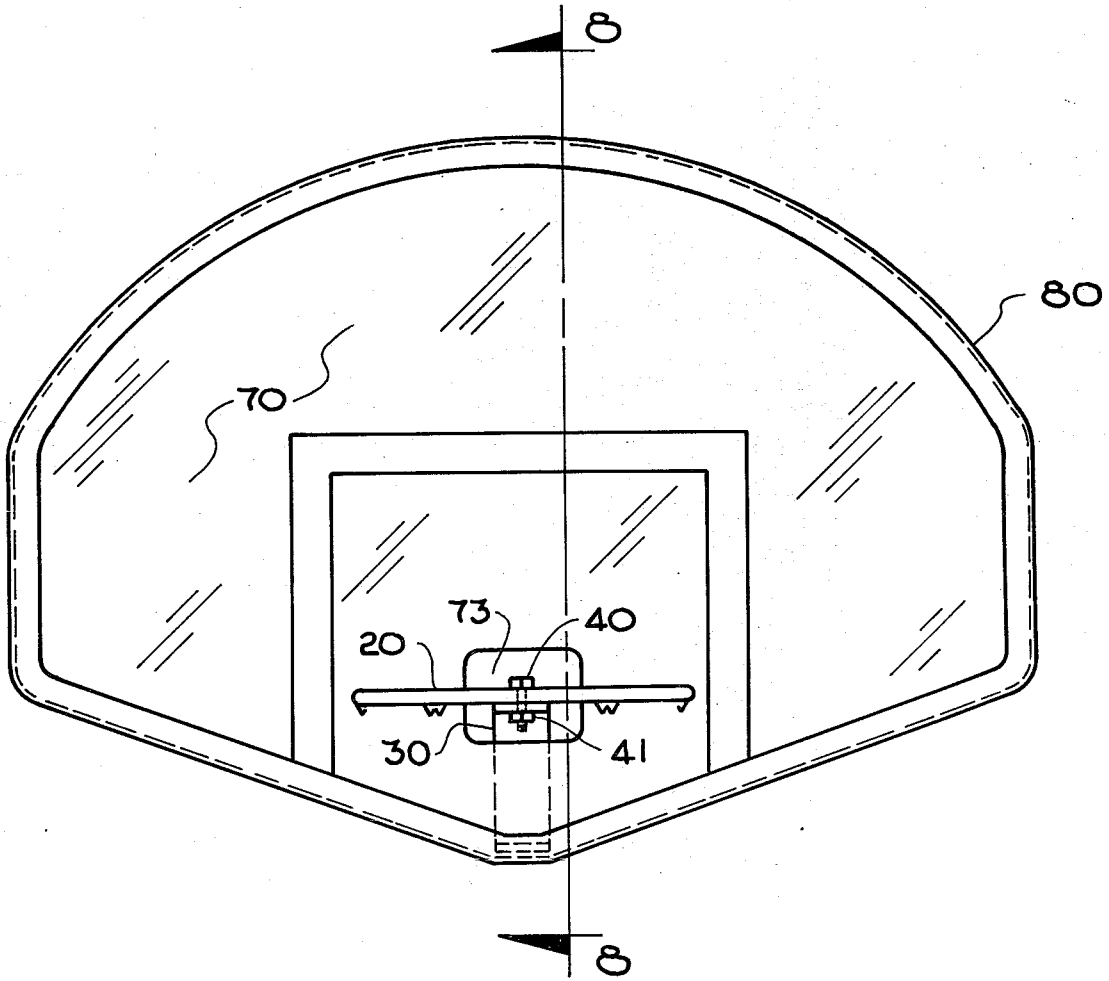
FIG. 7 is a front elevational view of the present invention showing a fan type backboard.
Figure 8:
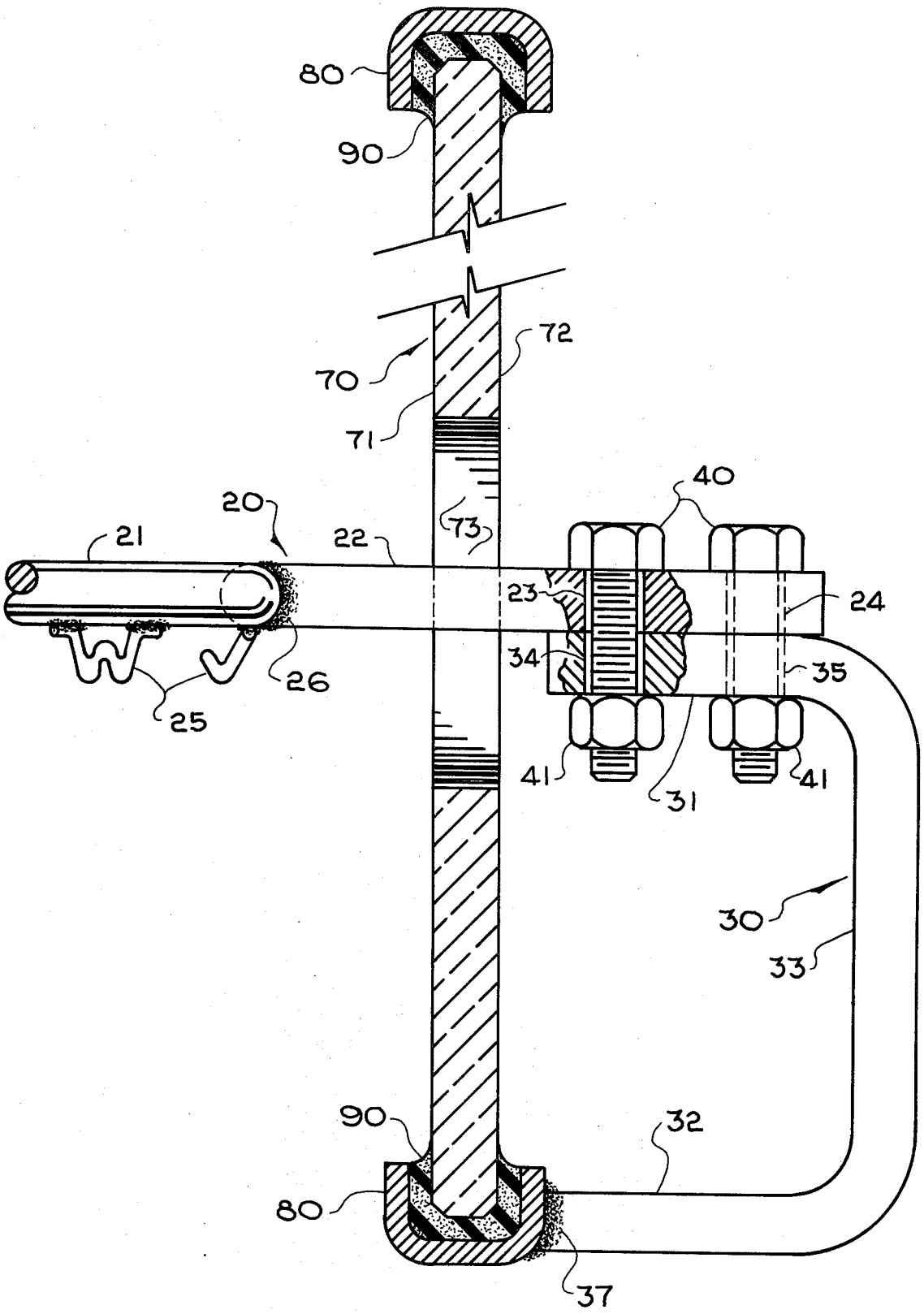
FIG. 8 is a section view of the present invention taken along line 8—8 of FIG. 7.

As shown in FIG. 1, the rectangular backboard 10 has a front surface 11, a back surface 12 and a cut out opening 13. As shown in FIG. 5, the front surface 11 of the rectangular backboard 10 is the surface facing the hoop 21 and the back surface 12 is the surface facing away from the hoop 21. The opening 13 is cut completely through the rectangular backboard 10. As shown in FIG. 6, the fan shaped backboard 70 has a front surface 71, a back surface 72 and a cut out opening 73. As shown in FIG. 8, the front surface 71 of the fan backboard 70 is the surface facing the hoop 21 and the back surface 72 is the surface facing away from the hoop 21. The opening 73 is cut completely through the fan backboard 70. Both the rectangular 10 and the fan 70 backboards are made from ½ inch or thicker tempered plate glass or of another suitable transparent material that can match or exceed the strength and transparency of that which is offered by tempered plate glass. The size and shape of both the rectangular 10, and fan 70 backboards shall be that which is known as standard as established by the rules and organizations which govern the games of basketball. The size of opening 13 in the rectangular backboard 10 and opening 73 in the fan backboard 70 should be approximately 6 inches long by 4 inches high with all corners having a rounded radius.

Figure 2:
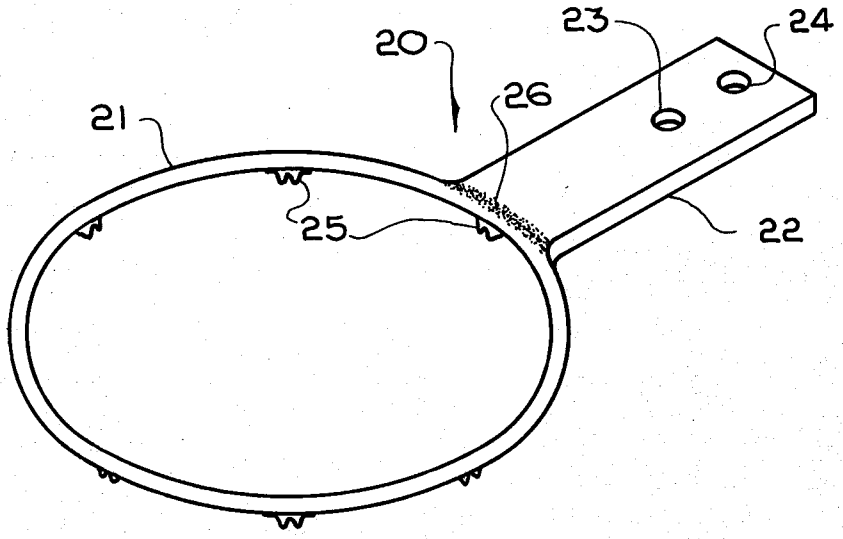
FIG. 2 is a perspective view of a hoop assembly embodying the present invention.
Figure 4:
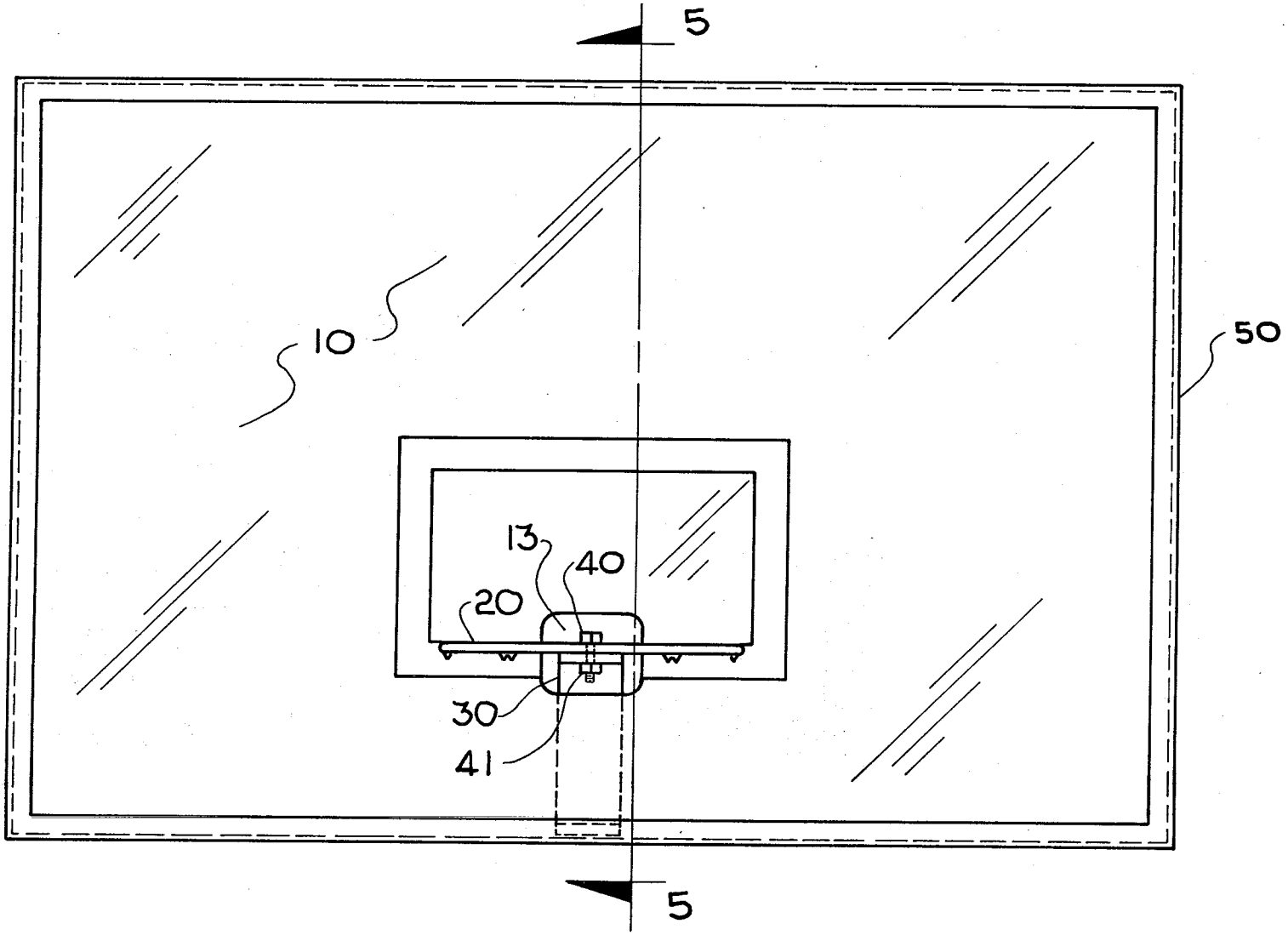
FIG. 4 is a front elevational view of the present invention showing a rectangular backboard.

As shown in FIG. 2, the hoop assembly 20 consists of a ring 21 and a backplate 22 both of which are joined together by a weld 26. The ring 21 is made from ⅝ inch round bar steel which is formed into an 18 inch diameter circle. Twelve net hooks 25 are equally spaced around the bottom surface of the ring 21. The backplate 22 is made from ⅝ inch flat plate steel. As shown in FIGS. 2, 5 and 8, the backplate 22 is welded 26 to the ring 21 and two mounting holes 23 and 24 are provided near the back end of the backplate 22.

Figure 3:
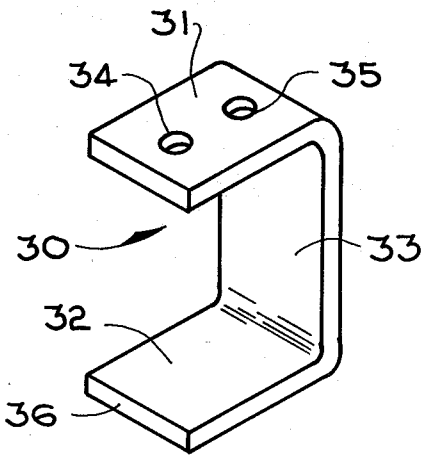
FIG. 3 is a perspective view of a mounting bracket embodying the present invention.

As shown in FIG. 3, the mounting bracket 30 is a formed channel having a top flange 31, a bottom flange 32 and a web 33. The mounting bracket 30 is made from ⅝ inch flat plate steel which is formed into a channel. As shown in FIGS. 3, 5 and 8 the top flange 31 of the mounting bracket 30 has two mounting holes 34 and 35 which are located to align with the two mounting holes 23 and 24 of the hoop assembly 20.

As shown in FIG. 5, the ring 21 of the hoop assembly 20 is positioned in front of the front surface 11 of the rectangular backboard 10. The backplate 22 of the hoop assembly 20 is projected through the center of opening 13 and extended beyond the back surface 12 of the rectangular backboard 10 where holes 23 and 24 of the hoop assembly 20 are lined up with holes 34 and 35 on the top flange 31 of the mounting bracket 30, and mounting bolts 40 and mounting nuts 41 are used to fasten the hoop assembly 20 to the mounting bracket 30. The front surface 36 (see FIG. 3) on the bottom flange 32 of the mounting bracket 30 is welded 37 to the steel rectangular backboard frame 50. Between the steel rectangular backboard frame 50 and the rectangular backboard 10 is a continuous rubber seal 60.

As shown in FIG. 8, the ring 21 of the hoop assembly 20 is positioned in front of the front surface 71 of the fan backboard 70. The backplate 22 of the hoop assembly 20 is projected through the center of opening 73 and extended beyond the back surface 72 of the fan backboard 70 where holes 23 and 24 of the hoop assembly 20 are lined up with holes 34 and 35 of the top flange 31 of the mounting bracket 30 and the mounting bolts 40 and mounting nuts 41 are used to fasten the hoop assembly 20 to the mounting bracket 30. The front surface 36 (see FIG. 3) on the bottom flange 32 of the mounting bracket 30 is welded 37 to the steel fan backboard frame 80. Between the steel fan backboard frame 80 and the fan backboard 70 is a continuous rubber seal 90.

While the invention has been disclosed and described in some detail in the drawings and foregoing description, they are to be considered as illustrative and not restrictive in character, as other modifications may readily suggest themselves to persons skilled in the art and within the broad scope of the invention, reference being had to the appended claims.

I claim:

1. A basketball goal comprising, a glass backboard, a metallic channel frame completely surrounding said backboard, a continuous resilient seal interposed between the surface of the glass backboard and the metallic channel frame to act as a shock absorber between the frame and backboard, an aperture in said backboard, a mounting bracket comprising a top flange, a bottom flange and a web connecting said top and bottom flanges, the bottom flange being secured to said frame below said aperture, and said top flange being positioned behind and centrally disposed with respect to said aperture, and a goal hoop assembly, said assembly comprising a goal hoop positioned in front of said aperture and a backplate, said backplate being secured at one end to said goal hoop and extending rearwardly therefrom through said aperture and secured at another end to the top flange of said mounting bracket, said aperture having dimensions greater than the cross section dimensions of said backplate in the area where said backplate passes through said aperture, whereby said goal assembly may move relative to said backboard without contacting said glass.

* * * * *